United States Patent [19]

Hyman

[11] Patent Number: 4,488,328

[45] Date of Patent: Dec. 18, 1984

[54] FLOATING HEAD TOOTHBRUSH

[76] Inventor: Richard M. Hyman, P.O. Box 552, Iowa City, Iowa 52244

[21] Appl. No.: 460,567

[22] Filed: Jan. 24, 1983

[51] Int. Cl.[3] ..... A46B 9/04

[52] U.S. Cl. ..... 15/167 R; 15/172; 15/201

[58] Field of Search ..... 15/172, 176, 167 R, 15/167 A, 110, 144 R, 145, 201

[56] References Cited

U.S. PATENT DOCUMENTS

| | | | |
|---|---|---|---|
| 416,596 | 12/1889 | Gould | 15/172 |
| 2,474,684 | 6/1949 | McCaughley | 15/208 X |
| 3,152,349 | 10/1964 | Brennesholtz | 15/201 X |
| 4,330,896 | 5/1982 | Booth | 15/172 |

FOREIGN PATENT DOCUMENTS

| | | | |
|---|---|---|---|
| 1227009 | 2/1960 | France | 15/172 |

*Primary Examiner*—Peter Feldman

*Attorney, Agent, or Firm*—Vorys, Sater, Seymour & Pease

[57] ABSTRACT

A toothbrush has an elongated handle and a brush head supported at one end of the handle for a limited pivotal movement between opposed arms of a yoke structure, i.e., by torsion bar support elements joining the support arms to opposed edges of the brush head. A further resilient element may be employed between the brush head and the proximal end of the handle to provide additional resistance to pivotal movement. Preferably the further resilient element is designed to have an increased spring constant as the brush head is pivoted progressively farther from its normal position in substantially coplanar relation with the handle and thus acts as an effective stop limiting maximum pivotal movement of the head. The base of the brush head which supports the brush bristles, the handle, yoke and resilient support elements may be integrally molded from a single mass of synthetic resin material and at least the resilient elements are preferably formed from polypropylene, or a polymeric material having substantially the same physical characteristics.

15 Claims, 6 Drawing Figures

FLOATING HEAD TOOTHBRUSH

This invention relates to toothbrushes, and more particularly to a toothbrush structure having a brush head supported for limited pivotal movement about an axis extending transversely of the longitudinal axis of the handle.

The conventional toothbrush employs an elongated handle having a brush head on one end, with the brush bristles projecting laterally from one face in a direction substantially perpendicular to the longitudinal axis of the handle. While such conventional toothbrushes are economical to produce, this construction is not the most efficient for cleaning the teeth in that the bristles of the brush head do not maintain maximum contact with the teeth during normal substantially straight line reciprocal, sweeping, or orbital brushing movement. To improve this brush contact, numerous attempts have been made to provide the brushes with pivoted head arrangements as shown, for example, in U.S. Pat. Nos. 2,122,619 to McMath, 2,474,684 to McCaughley and 4,333,199 to DelRosario and in French Patent No. 2,446,617. The known pivotal head toothbrushes such as those illustrated in these prior patents have not met with substantial commercial success for various reasons. For example, brush heads mounted for pivotal movement in all directions as in the DelRosario or French 617 patents fail to provide the desired brush head stability for brushing longitudinal of the teeth, i.e., in a direction away from the gums, as recommended by many dentists. Other pivoted head toothbrushes have provided such head stability about an axis parallel to the handle, but they have substantially unlimited pivotal action about an axis transverse to the handle. Further, assembly of the complex mounting structure has frequently been expensive, requiring multiple assembly procedures for inserting pivot pins, securing the pins in the head and handle structure, and the like. As pointed out in the McMath patent mentioned above, there has existed a problem in the safe or comfortable use of some of the prior art devices. Thus, there continues to be a need for safe, economical and efficient toothbrush having a head supported for movement relative to the brush handle to provide more efficient cleaning of the teeth and massaging of the gum tissue. It is, therefore, the primary object of the present invention to provide such an improved toothbrush structure.

Another object of the invention is to provide an improved toothbrush having a brush head mounted on an elongated handle for limited pivotal movement about an axis extending transversely of the longitudinal axis of the handle.

Another object is to provide such an improved toothbrush construction wherein the pivotal action is resiliently resisted.

Another object is to provide such an improved toothbrush construction including a brush head mounted for limited pivotal movement on a brush handle by head support means integrally formed with the head and handle structure.

Another object is to provide such an improved toothbrush construction wherein pivotal movement of the brush head relative to the handle is resiliently resisted by at least one resilient element integrally formed with the brush head and handle.

In attainment of the foregoing and other objects and advantages, an important feature of the present invention resides in providing a toothbrush having a brush head including bristles mounted on and projecting from one surface in the conventional manner for engaging and cleaning the teeth, and an elongated handle adapted to be held in one hand of a person using the device with normal brush manipulating movements. The brush head is supported on the handle and normally retained in a position substantially in alignment with and forming a longitudinal continuation of the handle, but being capable of limited resiliently resisted pivotal movement about an axis extending transversely of the handle and generally parallel to the plane of the brush head. Preferably the handle portion is formed with a yoke structure at one end, with the yoke including two arms laterally spaced from one another to receive the brush head therebetween, and a resilient torsion bar structure extending between the brush head and each of the yoke arms supports the brush head for limited resiliently resisted pivotal movement about a transverse axis defined by the torsion bar members. Preferably, the brush head, yoke arms and torsion bar structure are integrally formed from a single mass of synthetic resin material, with at least the torsion bar members being a polypropylene material, or a polymeric material having substantially the same physical characteristics, which provides excellent resistance to fatigue failure.

Also in the preferred embodiment, a second resilient element is provided between the brush head and the handle structure to reinforce the torsion bar support and limit pivotal movement. This second resilient element may also consist of an integrally formed synthetic resin hinge member which may be configured to offer increased resistance to pivotal movement of the brush head as the head is pivoted from its normal position.

Other features and advantages of the invention will be apparent from the detailed description contained hereinbelow, taken in conjunction with the drawings, in which.

Figure 1:
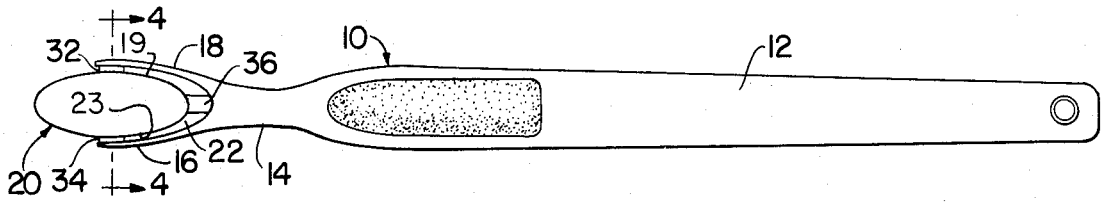
FIG. 1 is a plan view of a toothbrush embodying the present invention.

Referring now to the drawings in detail, an improved toothbrush according to the present invention is designated generally by the reference numeral 10 and includes an elongated handle 12 having a neck portion 14 adjacent its proximal end, with the neck portion being of reduced cross-sectional area in accordance with conventional toothbrush constructions. Neck portion 14 terminates in a bifurcated yoke or fork structure defined by a pair of spaced arms 16, 18 adapted to support a brush head 20. As best seen in FIG. 1, brush head 20 is generally elliptical in plan view and is dimensioned to fit between the yoke arms 16, 18 with substantial clearance space as shown at 22. Alternatively the brush head may be, for example, rectangular or generally triangular. Brush head 20 includes a base member 24 having one substantially flat face surface 26, and a body of brush bristles 28 firmly attached in the body 24 project substantially perpendicularly from surface 26. The brush head 20 further includes side edge surfaces 19, 23 on opposite sides of the base 20. The surface 30 opposite face 26 is preferably contoured to present smooth, rounded edges for comfortable use in the mouth during brushing of the teeth.

Brush head 20 is supported between arms 16, 18 for limited pivotal movement about an axis transverse to the longitudinal axis of handle 12 and generally parallel to the face surface 26 by a pair of trunnion like support members 32, 34. Support members 32, 34 are preferably integrally formed with the base member 24 and the arms 16, 18, and act as torsion bars to provide both support for the brush and limited resistance to pivotal movement about the common axis of the two support members. This integral construction eliminates the usual complex assembly operations required for attaching the brush head to the handle and provides for a stronger, more positive support for the brush head while assuring against unintentional dislodgement of the head from the yoke support. It should be apparent, however, that the support members per se could be separately formed or integrally formed with either the handle or the brush head and subsequently attached to the other of the handle or brush head. For example, the handle and head portions may be formed from a synthetic resin material by separate molding operations, with the trunnion like support members being integrally formed with one member and permanently joined to the other during a final molding operation. Alternatively, the arms 16, 18 might be relied upon to provide a clamping force sufficient to retain the support members, integrally formed on one of the handle or brush head, into engagement with a cooperating receiving slot in the other.

Figure 3:
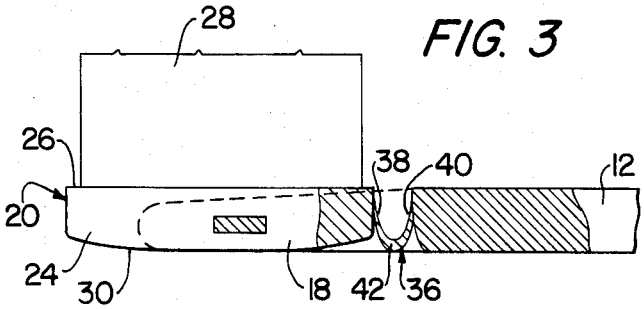
FIG. 3 is an elevational view partly in section of the toothbrush in its normal position.
Figure 4:
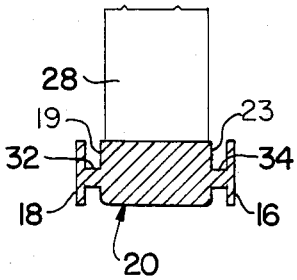
FIG. 4 is a sectional view, on an enlarged scale, taken along line 4—4 of FIG. 1.
Figure 5:
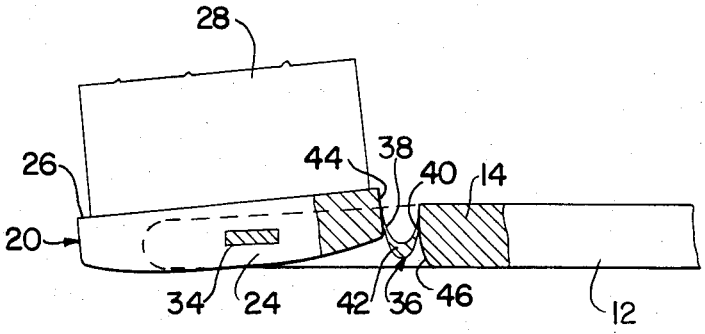
FIG. 5 is a view similar to FIG. 3 and showing a portion of the structure in an alternate position.

As best seen in FIGS. 4 and 5, in the preferred embodiment of the invention a second resilient hinge-like spring element 36 is employed between the base 24 and the proximal end of neck portion 14 of handle 12. Again, preferably the spring element 36 is integrally formed with the base 24 and the neck portion 14 of handle 12. Spring 36 is generally U-shaped (although in another form it may be S-shaped) and has its open end portions connected one to the handle 12 and the other to the brush head body 24. The opposed arm portions 38, 40 of the U-shaped spring element 36 are of gradually reduced cross-sectional area toward their end portions which are joined to body 24 and handle 12, respectively, whereas the bottom closed portion 42 of the spring is of relatively heavy cross section. This configuration offers relatively little resistance to pivotal movement of the brush head 20 about its principal support axis during initial movement from its normal position in which the brush head body is substantially parallel with the arms 16, 18; however, as displacement of the brush head increases, for example in the direction illustrated in FIG. 5, the edge surface 44 of the body 24 will ultimately bear against the outer surface of leg 38 along substantially its full length and the spring constant of spring element 36 will be sharply increased. Conversely, as the brush head is rotated clockwise in FIGS. 3 and 5, the outer surface of arm 40 will ultimately come to bear against the outer end surface 46 of neck portion 14 and again the spring constant of spring element 36 will be sharply increased. Thus, upon initial displacement of the brush head from its normal coplanar relation with the handle, the torsion bar support elements 32, 34 provide the principal resistance to such pivotal movement. As the displacement of head 20 increases, increased resistance is offered by the spring element 36, with this resistance being gradual at first and increasing sharply at the point corresponding to maximum desired deflection of the brush head.

Again, while spring element 36 is preferably integrally formed with the handle 12 and brush head body 24, or at least with one of them and subsequently joined to the other, the spring element may be separately formed and attached in a separate operation.

Figure 2:
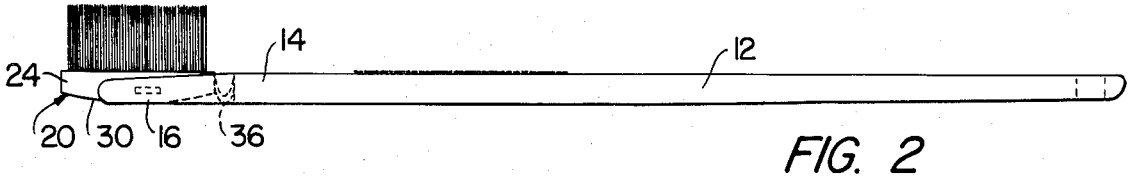
FIG. 2 is an elevation view of the structure shown in FIG. 1 with portions broken away to more clearly show the brush head support.

As indicated above, the handle 12 and brush head body 24 are preferably integrally molded from a synthetic resin material. Polypropylene or similar polymeric material, is a preferred material for at least the torsion bar support elements 32, 34 and the resilient spring element 36, and may be used to integrally mold the entire assembly in one molding operation from a single substantially homogeneous mass of polypropylene material. Alternatively, separate but compatible materials may be used to mold portions of the assembly with the preferred polypropylene material being employed to mold at least the portions constituting these resilient elements. Polypropylene is preferred because of its ability to resist fatigue failure upon flexing as in a hinge or a resilient spring element. Other materials may, of course, be employed to provide the desired resilient resistance to pivotal movement to enable easy and efficient use in cleaning of the teeth while normally maintaining the device, when not in use, in its substantially coplanar relation as illustrated in FIG. 2.

Figure 6:
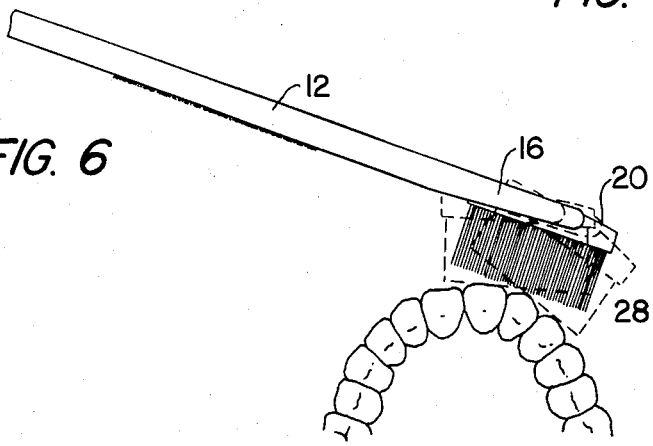
FIG. 6 is a schematic view illustrating the improved toothbrush being employed to clean the teeth, with the brush head being shown in broken lines in alternate positions.

In use of the device as illustrated in FIG. 6, the handle 12 may be grasped in the normal manner and the brush head inserted into the mouth for brushing of the teeth. The broken line positions of the brush head are automatically assumed as straight line reciprocal movement of the handle is effected so that maximum brush area contact with the teeth is automatically achieved regardless of the area being brushed. Also, when a brushing action longitudinally of the teeth, or an up and down motion or orbital motion is desired, the head support structure provides stability to avoid pivotal movement about the longitudinal axis of the handle.

While preferred embodiments of the invention have been disclosed or described, it should be understood that the invention is not so limited and that it is intended to include all embodiments of the invention which would be apparent to one skilled in the art and which come within the spirit and scope of the invention.

What is claimed is:

1. A tooth brush comprising, an elongated handle, a brush head including a base having a face surface, a back surface and side edge surfaces extending between said face and back surface, and brushing bristles projecting from said face surface, a pair of laterally spaced arms projecting from one end of said handle in laterally spaced relation to said side edge surfaces on opposite sides of said base, said arms cooperating with said handle to define a yoke for supporting said brush head, and mounting means extending between each of said arms and the adjacent said side edge surface of said base for supporting said brush head in said yoke, said mounting means normally maintaining said brush head in a first position with said face surface generally parallel to said arms and being capable of limited torsional deflection to permit limited pivotal movement of said brush head from said first position about a pivot axis extending transversely of the longitudinal axis of the handle and being sufficiently rigid in bending to prevent substantial pivotal movement about the longitudinal axis of said elongated handle.

2. The toothbrush defined in claim 1 wherein said arms, said base and said mounting means are integrally molded from a single mass of synthetic resin material.

3. The toothbrush defined in claim 1 wherein said mounting means comprises a pair of short bars of polypropylene material each molded integrally with and extending between one of said arms and said base.

4. The toothbrush defined in claim 1 wherein said yoke, said mounting means and said base are integrally molded from a single substantially homogeneous mass of polypropylene material.

5. The toothbrush defined in claim 1 further comprising resilient means operatively associated with said yoke and said brush head and cooperating with said mounting means to provide limited resilient resistance to said pivotal movement of said brush head about said pivot axis.

6. The toothbrush defined in claim 5 wherein said resilient means comprises a resilient element connected to said yoke at a location between said arms at the end of said handle and connected to said base, said resilient element offering a minimum of resistance to said pivotal movement when said brush head is in said first position and increased resistance to such pivotal movement as the brush head is pivoted from said first position.

7. The toothbrush defined in claim 5 wherein said resilient element comprises a generally U-shaped element disposed between said base and the adjacent end portion of said handle, said U-shaped member having its open end portions connected one to said side surface of said base adjacent the end portion of said handle and the other to the adjacent end portion of said handle.

8. The toothbrush defined in claim 7 wherein the closed end portion of said U-shaped element is of increased cross-sectional area relative to the remainder thereof, said closed end portion being positioned to be clamped between said body and the adjacent end portion of said handle to limit said pivotal movement.

9. The toothbrush defined in claim 8 wherein said U-shaped element is formed from a polypropylene material and wherein said brush head comprises an elliptical contour.

10. The toothbrush defined in claim 5 wherein said resilient element, said arms, said mounting means and said base are integrally molded from a single mass of synthetic resin material.

11. The toothbrush defined in claim 10 wherein said synthetic material is polypropylene.

12. The toothbrush defined in claim 11 wherein said resilient means comprises a resilient element connected to said yoke at a location between said arms at the end of said handle and connected to said base, said resilient element offering a minimum of resistance to said pivotal movement when said brush head is in said first position and increased resistance to such pivotal movement as the brush head is pivoted from the normal postion.

13. The toothbrush defined in claim 11 wherein said resilient element comprises a generally U-shaped element disposed between said base and the adjacent end portion of said handle, said U-shaped member having its open end portions connected one to said side surface of said base portion adjacent the end portion of said handle and the other to the adjacent end portion of said handle.

14. The toothbrush defined in claim 13 wherein the closed end portion of said U-shaped element is of increased cross-sectional area relative to the remainder thereof, said closed end portion being positioned to be clamped between said body and the adjacent end portion of said handle to limit said pivotal movement.

15. The toothbrush defined in claim 5 wherein said resilient element has a low spring constant when said brush head is in said first position and wherein the spring constant increases progressively as the brush head is pivoted in either direction about said pivot axis.

* * * * *